US006980841B2

(12) United States Patent
Kai et al.

(10) Patent No.: US 6,980,841 B2
(45) Date of Patent: Dec. 27, 2005

(54) FILTER DEVICE HAVING SPIRAL RESONATORS CONNECTED BY A LINEAR SECTION

(75) Inventors: Manabu Kai, Kawasaki (JP); Kazunori Yamanaka, Kawasaki (JP); Teru Nakanishi, Kawasaki (JP); Akihiko Akasegawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/916,756

(22) Filed: Aug. 12, 2004

(65) Prior Publication Data

US 2005/0009709 A1 Jan. 13, 2005

Related U.S. Application Data

(63) Continuation of application No. PCT/JP02/01974, filed on Mar. 5, 2002.

(51) Int. Cl.[7] ..... H01P 1/203; H01B 12/02
(52) U.S. Cl. ..... 505/210; 333/99 S; 333/204; 333/219; 505/700; 505/701
(58) Field of Search ..... 333/99 S, 204, 333/219; 505/210, 866, 700, 701

(56) References Cited

U.S. PATENT DOCUMENTS 5,066,933 A * 11/1991 Komeda ..... 333/204
6,108,569 A 8/2000 Shen
6,522,217 B1 * 2/2003 Shen ..... 333/99 S

FOREIGN PATENT DOCUMENTS

JP 2001-77609 3/2001
WO WO 00/52782 9/2000

OTHER PUBLICATIONS

C.K. Ong High-Temperature Superconducting Bandpass Spiral Filter, IEEE Microwave and Guided Wave Letters, vol. 9, No. 10, Oct. 1999 pp. 407-409.
International Preliminary Examination Report dated Jul. 24, 2002.

* cited by examiner

*Primary Examiner*—Benny T. Lee
(74) *Attorney, Agent, or Firm*—Katten Muchin Roseman LLP

(57) ABSTRACT

A resonator is formed by forming a microstrip line having an electrical length corresponding to a λ/2 wavelength on a dielectric substrate, forming both side portions of the microstrip line from the center thereof into spiral shapes, making the orientations of the spirals opposite each other, making outer-side portions of the spiral shapes on both sides, inclusive of the central portion of the microstrip line, linear in shape overall, and making linear in shape a portion of prescribed range from the end portion of each spiral shape.

6 Claims, 8 Drawing Sheets

FILTER DEVICE HAVING SPIRAL RESONATORS CONNECTED BY A LINEAR SECTION

CROSS-REFERENCE TO RELATED APPLICATION

The present application is a continuation of International Application number PCT/JP02/01974 filed on Mar. 5, 2002.

BACKGROUND OF THE INVENTION

This invention relates to a resonator and filter device. More particularly, the invention relates to a resonator that includes a microstrip line, which has an electrical length corresponding to a λ/2 wavelength, formed on a dielectric substrate, and to a filter obtained by provided a plurality of the resonators side by side on a dielectric substrate.

There is increasing activity toward the introduction of superconducting filters, which exhibit little loss in the pseudo-microwave band, for use in base stations for mobile communications. In general, the number of filter stages (number of resonators) must be enlarged in order to obtain a steep cut-off characteristic in filters for communication purposes. However, a problem which arises is a commensurate increase in pass band loss. Accordingly, the fact that a superconductor has a resistance that is two to three orders of magnitude lower than that of ordinary metal has become the focus of attention, and there is increasing introduction of superconducting filters adapted so as to minimize loss in the pass band by using a superconductor as the conductor of a filter. In particular, superconducting filters have in recent years become noteworthy as promising means for effectively utilizing frequency in mobile-band communications, increasing subscriber capacity and enlarging the area of base-station coverage.

YBCO (Y.Ba.Cu.O) having a critical temperature (Tc) on the order to 90 K is known as a superconducting material for superconducting filters. It is used at a Tc of 70 to 80 K, at which characteristics are stable.

FIG. 10 is a diagram illustrating the structure of a conventional radio-reception amplifying device equipped with a superconducting filter. A superconducting filter (SCF) 1 and a low-noise amplifier (LNA) 2 are secured on a cold head 4 and accommodated in a vacuum vessel 3. The cold head 4 is cooled by a freezer or refrigerator 5. The superconducting filter 1 and low-noise amplifier 2 are cooled by the freezer 5 via the cold head 4 and operate at Tc=70 K. The vacuum vessel 3 and freezer 5 are placed inside a case 6 so that they can be installed outdoors, terminals 7*a*, 7*b* and 8*a*, 8*b* provided on the case 6 and vacuum vessel 3 are connected by coaxial cables 9*a*, 9*b*, and terminal 7*b*→superconducting filter 1→low-noise amplifier 2→terminal 8*b* also are connected by a cable 9*c*. A receive signal 10 is input to the terminal 7*a*.

As shown in (A) and (B) of FIG. 11, the superconducting filter 1 has a structure obtained by patterning, using YBCO film, filter electrodes 1*b*1, 1*b*2 and n stages (n=5 in the illustration) of λ/2 resonators $\mathbf{1}c_1$ to $\mathbf{1}c_5$ on an MgO substrate 1*a* of thickness t=0.5 mm, and sealing these in a package 1*d* made of an aluminum alloy as best seen in (A) of FIG. 11. The package 1*d* prevents leakage of electromagnetic field and cools the filter substrate 1*a* uniformly. In FIG. 11, (A) is a plan view in which an upper cover 1*e* (see (B) of FIG. 11) of the package has been removed, and (B) is a sectional view taken along line AA in (A). Further, reference characters 1*f*, 1*g* represent coaxial connectors and 1*h* (see (B) of FIG. 11) a ground plane formed by a YBCO film having a thickness of 0.4 μm.

In order to operate the superconducting filter at T=70 to 80 K, as mentioned above, the superconducting filter must be placed in the vacuum vessel, insulated from the outside and cooled using a refrigerator. To accomplish this, it is required that the filter be made small in size. Conventionally, use is made of a filter having a hairpin-shaped resonator structure formed by a microstrip line, as illustrated in (A) of FIG. 11. The hairpin filter has a simple resonator structure and a large number of prior art references have been published. The design is very simple and has become the basic structure of superconducting filters.

When such a hairpin filter, e.g., a hairpin filter (see FIG. 12) having a center frequency of 2 GHz, a bandwidth of 20 MHz and nine filter stages is designed, the size thereof is on the order of 525 $mm^2$. More specifically, if the distance between hairpin resonators $\mathbf{1}c_1$, $\mathbf{1}c_2$, $\mathbf{1}c_3$, $\mathbf{1}c_4$, $\mathbf{1}c_5$, $\mathbf{1}c_6$, $\mathbf{1}c_7$, $\mathbf{1}c_8$, $\mathbf{1}c_9$ is uniquely decided from filter design values and the resonators are disposed at this spacing, the dimensions of a single hairpin resonator are about 15 mm×2 mm vertically and horizontally. The dimensions of the overall filter and the occupied area are 15 mm×35 mm=525 $mm^2$ vertically and horizontally. In FIG. 12. 1*a* denotes MgO substrate, $\mathbf{1}b_1$ and $\mathbf{1}b_2$ filter electrodes. 1*d* a package and 1*g* a coaxial connector.

In the superconducting hairpin filter, material constants vary and so do patterning precision in actuality. It is necessary to subject the resonator length of each individual resonator to trimming by a laser, adjust the resonance frequency of each oscillator and make an adjustment so as to obtain the desired filter characteristics. An example of a trimming method that can be mentioned is a method of trimming a superconducting filter by a laser in an operating temperature environment of low temperature.

Even if the superconducting hairpin filter is small in size, a plurality of filters are required simultaneously depending upon the communication system, and it is necessary that these be cooled by a single refrigerator. The insulated vacuum vessel becomes enormous, the overall receiving apparatus becomes large in size and of increased weight.

For example, in the 800-MHz band or 2-GHz band (IMT-2000), the base station apparatus requires two filters in one sector. In six sectors, that is a total of 12 filters required. Power consumption by the refrigerator is about 100 W per sector. If, by way of example, one refrigerator is used for every sector, about 600 W will be required for the six sectors, thereby necessitating several thousand watts of power consumption for the entire base station. Accordingly, cooling as many filters as possible simultaneously by one refrigerator is required in order to reduce power consumption by the overall base station and lower cost. Further, if filter area is large, there will be an increase in heat radiated from the vacuum vessel and an increase in power consumption by the refrigerator. For these reasons, it is desired that the filter be further reduced in size.

Further, if trimming is performed by a laser or the like, a very high machining precision is required conventionally. That is, a planar-circuit-type filter forming a pattern on a substrate is such that even if pattern formation is performed accurately by carrying out etching in accordance with the design pattern, the oscillation frequencies of each of the resonators will differ from the design values due to variations in specific inductivity of the dielectric substrate and unevenness of the substrate. Accordingly, the pattern of the resonator is formed somewhat long and the desired resonance frequency is adjusted by cutting off the resonator end REP (see FIG. 12) using a laser or the like while the resonance frequency of each resonator is measured by a probe or the like. This is carried out for all of the resonators. However, this task relies upon human intervention and must be performed with precision. For these reasons, a structure having high redundancy with regard to trimming, i.e., a filter that exhibits little change in characteristics with regard to trimming, is desired.

SUMMARY OF THE INVENTION

Accordingly, an object of the present invention is to provide a small-size resonator and filter.

Another object of the present invention is to provide a resonator and filter that exhibit little change in characteristics with regard to trimming and that can be trimmed readily so as to obtain the desired characteristics.

According to the present invention, a resonator is constructed by forming a microstrip line having an electrical length corresponding to a $\lambda/2$ wavelength on a dielectric substrate, forming both side portions of the microstrip line from the center thereof into spiral shapes, making the orientations of the spirals opposite each other, and making outer-side portions of the spiral shapes on both sides, inclusive of the central portion of the microstrip line, linear in shape overall. Further, a plurality of these resonators are provided side by side on the dielectric substrate to construct a filter.

In accordance with such a resonator and filter, longitudinal size can be reduced by adopting the spiral shape. Moreover, since the spirally shaped portions are placed side by side, capacitative coupling (a proximity effect) is produced between these portions and the length of $\lambda/2$ wavelength can be reduced while maintaining the same resonance frequency, thereby making it possible to reduce the size of the resonator.

Further, by adopting the spiral shape, the coupling coefficient between resonators constructing a filter can be reduced, and since the spacing between them can be reduced, the transverse size of the filter can be diminished and the filter can be reduced in size.

Further, a considerable range that includes the central portion of the microstrip line (a portion of $\lambda/4$ wavelength from the end portion of the line) where current concentrates is made linear in shape to eliminate a curved portion, and therefore current density can be reduced in comparison with a case where a curved portion is present. As a result, withstand power can be raised and the occurrence of distortion prevented.

Further, a portion of prescribed range from the end portion of each spiral shape of the resonator is made linear in shape. If this expedient is adopted, variation in characteristics in a case where the length of the linear portion has been changed can be reduced in comparison with the conventional hairpin filter. That is, trimming can be performed with ease so as to obtain the desired characteristics.

BRIEF DESCRIPTION OF THE DRAWINGS

DESCRIPTION OF THE PREFERRED EMBODIMENTS (a) Shape of Microstrip-Line Resonator FIG. 2 is an enlarged view illustrating a spiral shape of the microstrip-line resonator.

Figure 1:
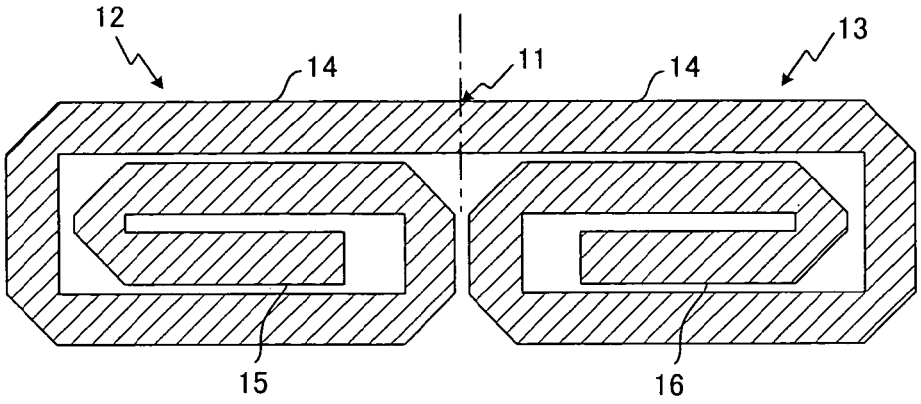
FIG. 1 is a diagram illustrating the shape of a microstrip-line resonator of the present invention formed on a dielectric substrate.

It is assumed that a superconducting filter (center frequency f0=1.93 GHz) of a microstrip line is formed on a dielectric substrate MgO (magnesium oxide) having a thickness of 0.5 mm, and the structure of a resonator that constructs this filter has been decided, as shown in FIG. 1, using an electromagnetic-field simulator. Furthermore, it is assumed that the microstrip line is formed using a YBCO film.

The electromagnetic-field simulator is a software tool for implementing prediction of the performance of a high-frequency circuit board, antenna and IC, etc. Various tools are available on the market and can be utilized. In accordance with this electromagnetic-field simulator, an S parameter is calculated and a frequency characteristic is output if the pattern and electrical conductivity of the microstrip-line formed on a microprint board are given. For example, if the pattern and electrical conductivity of the microstrip-line formed on a microprint board are given, there are calculated and output the resonance characteristic of a resonator obtained by forming the pattern on a dielectric substrate by a microstrip line having an electrical length corresponding to a $\lambda/2$ wavelength, as well as the frequency characteristic of a filter obtained by arraying n stages of this resonator side by side.

As shown in FIG. 1, a micro strip-line resonator according to the present invention is constructed by forming both side portions 12, 13 of a microstrip line, which has a total length of substantially a $\lambda/2$ wavelength, from the center 11 thereof into spiral shapes, making the orientations of the spirals opposite each other, making outer-side portions 14 of the spiral shapes on both sides, inclusive of the central portion 11 of the microstrip line, linear in shape overall, and further making linear in shape portions 15, 16 of prescribed ranges from the end portions of each of the spiral shapes. The spirally shaped portions 12, 13 constitute spiral structures of overall rectangular shape having 90° bends at a total of 12 locations. They are made compact so as to make the occupied area as small as possible. In one example shown in FIG. 2, the distances between the bands are $L_1$, $L_2$, $L_3$, $L_4$ and $L_5$ and the actual dimension of each portion in the spiral structure is shown by numeral values of 0.2. 0.3. 04. 0.45. 0.5 and 2.05 (mm (b) Filter Structure FIG. 3 is a diagram for describing a filter according to the present invention. Nine microstrip-line resonators $\mathbf{22}_1$ $\mathbf{22}_2$, $\mathbf{22}_3$, $\mathbf{22}_4$, $\mathbf{22}_5$, $\mathbf{22}_6$, $\mathbf{22}_7$, $\mathbf{22}_8$ and $\mathbf{22}_9$ of the type shown in FIG. 1 are arrayed side by side on a dielectric substrate 21 of MgO (magnesium oxide) having a thickness of 0.5 mm. A linear electrode 23 is placed in parallel with the linear outer-side portion 14 of one spirally shaped portion 12 of the resonator 22 on the input side, and an input-signal terminal 24 of the filter and the linear electrode 23 are connected in such a manner that the direction of the linear outer-side portion 14, when the spirally shaped portion 12 follows in the spiral direction from the end portion thereof, will agree with the direction from a signal input end 23*a* of the linear electrode 23 to the other end 23*b*. Further, a linear electrode 25 is placed in parallel with the linear outer-side portion 14 of one spirally shaped portion 13 of the resonator $\mathbf{22}_9$ on the output side, and a signal output terminal 26 of the filter and the linear electrode 25 are connected in such a manner that the direction of the linear outer-side portion 14, when the spirally shaped portion 13 follows in the spiral direction from the end portion thereof, will agree with the direction from a signal output end 25*a* of the linear electrode 25 to the other end 25*b*. Furthermore, the spacing between the linear electrode 25 and resonator $\mathbf{22}_8$ is made much greater than the spacing between the linear electrode 25 and resonator $\mathbf{22}_9$.

The reason for providing the linear electrodes 23, 25 in the manner described above is that this best strengthens the coupling between the linear electrodes 23, 25 and resonators $\mathbf{22}_1$, $\mathbf{22}_9$ and enlarges the gain.

(c) Relationship Between Resonance Frequency and Length of Each Side

Figure 2:
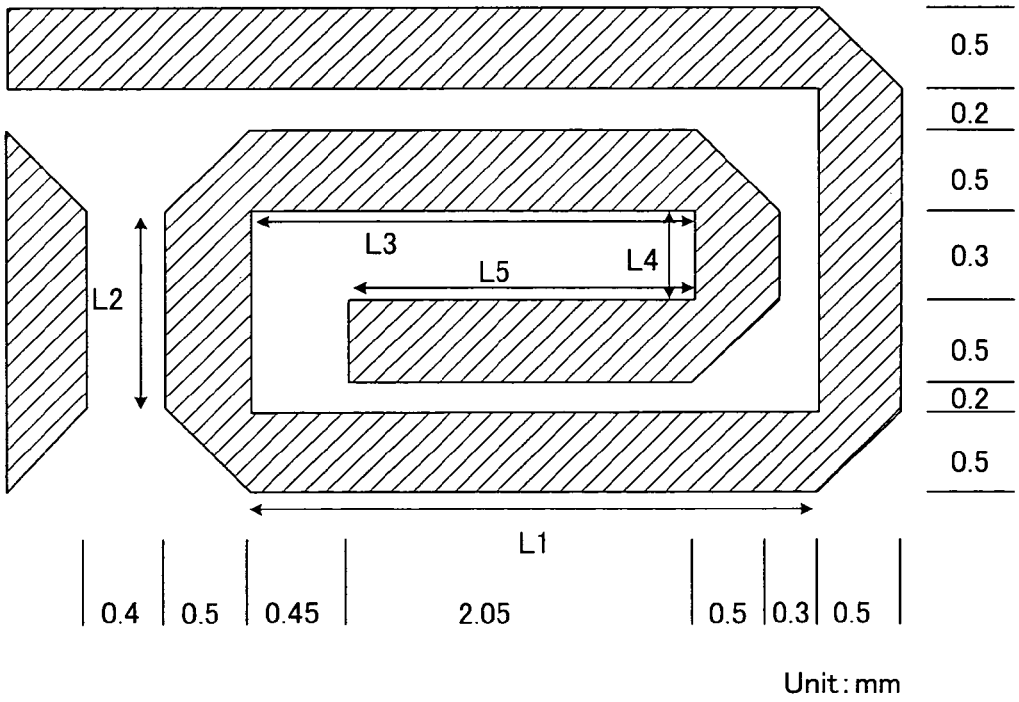
FIG. 2 is an enlarged view illustrating a spiral shape of a microstrip-line resonator.
Figure 3:
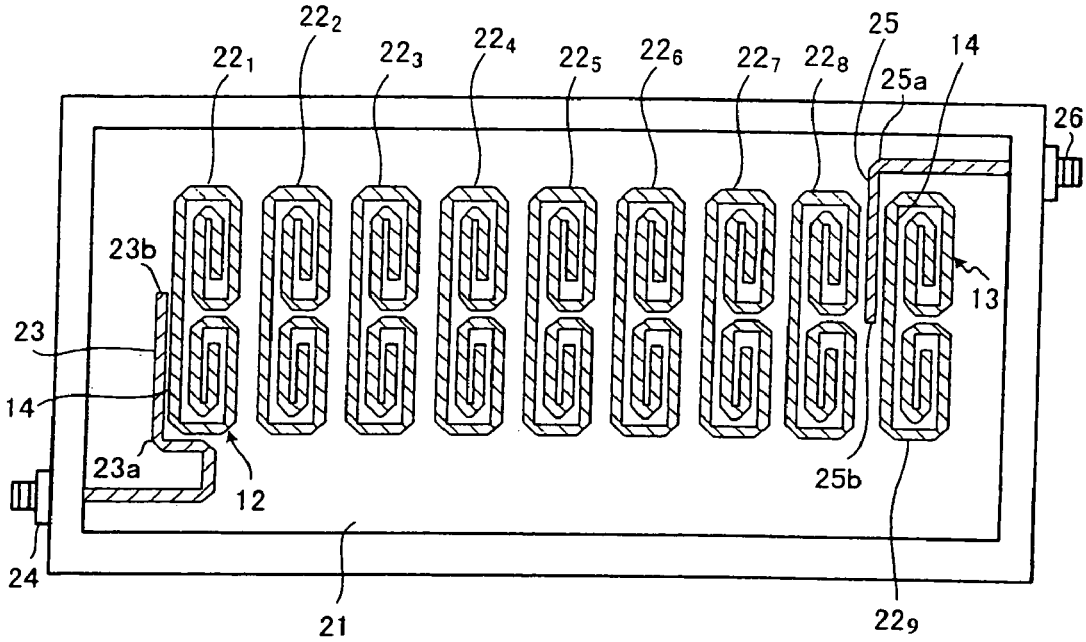
FIG. 3 is a diagram for describing a filter according to the present invention.

In the microstrip-line resonator of FIG. 1, the provisional dimensions of each of the sides that construct the spirally shaped portions 12, 13 are decided in the manner shown in FIG. 2 in such a manner that resonance frequency f0=1.93 GHz will be obtained. How the resonance frequency of the resonator changes when lengths L1, L2, L3, L4, L5 of the sides are adopted as parameters and each length is changed was investigated and the results shown in FIG. 4 were obtained. Since overall length L of the resonator and resonance frequency $f_0$ usually are inversely related, the curve ($\Delta L-f_0$ characteristic) of this relationship is illustrated simultaneously. The $\Delta L-f_0$ characteristic is a characteristic that applies to the conventional hairpin filter as well.

Figure 4:
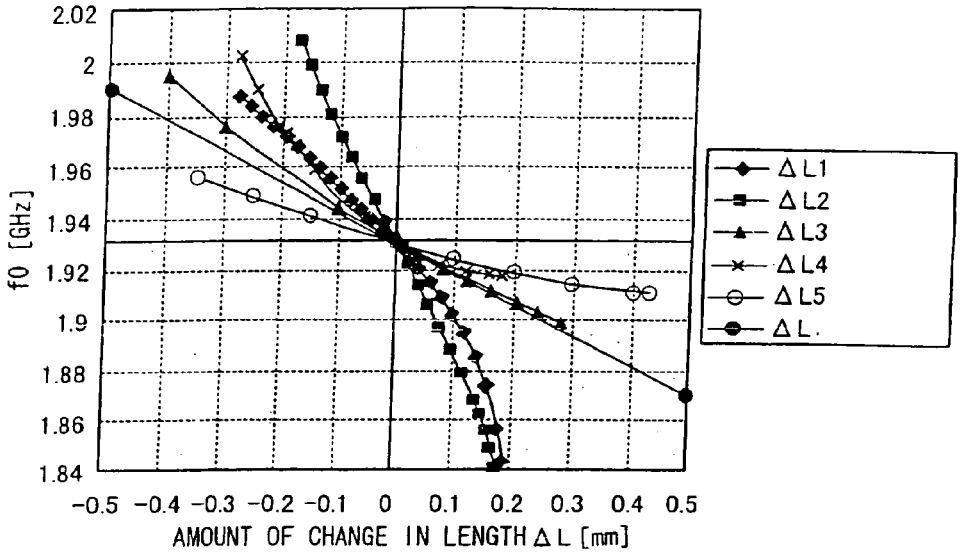
FIG. 4 shows curves illustrating the relationship between amount of change in dimensions and center frequency.

What is evident from FIG. 4 is that when L1 or L2 (FIG. 2) is changed, the rate of change in resonance frequency increases, whereas when L5 (FIG. 2) is changed, the change in resonance frequency diminishes. In particular, if the $\Delta L-f_0$ characteristic and $\Delta L_5-f_0$ characteristic are compared, it will be understood that the $\Delta L_5-f_0$ characteristic has the gentler slope and that the change in resonance frequency is small. The reason why the change in L5 results in little change in resonance frequency is that redundancy in the length direction with respect to resonance frequency is large.

(d) Trimming

When a filter is fabricated, the resonance frequency of each resonator shifts from its original design value owing to variations in the material constants of the substrate and unevenness of the substrate. For this reason it is necessary to form the filter pattern somewhat long, adjust the length of each resonator by trimming and readjust the characteristic of the overall filter to the desired characteristic. In the present invention, L5, which is insensitive to a change in resonance frequency, is trimmed by a laser or the like to enable the resonance frequency to be adjusted, and it is unnecessary to raise the mechanical precision of trimming that much. In other words, according to the present invention, fine adjustment of resonance frequency can readily be adjusted because L5 is trimmed. More specifically, trimming is carried out by a method described in "Japanese Patent Application Laid-Open No. 7-254734, Method and Apparatus for Adjusting Superconducting Device".

Figure 12:
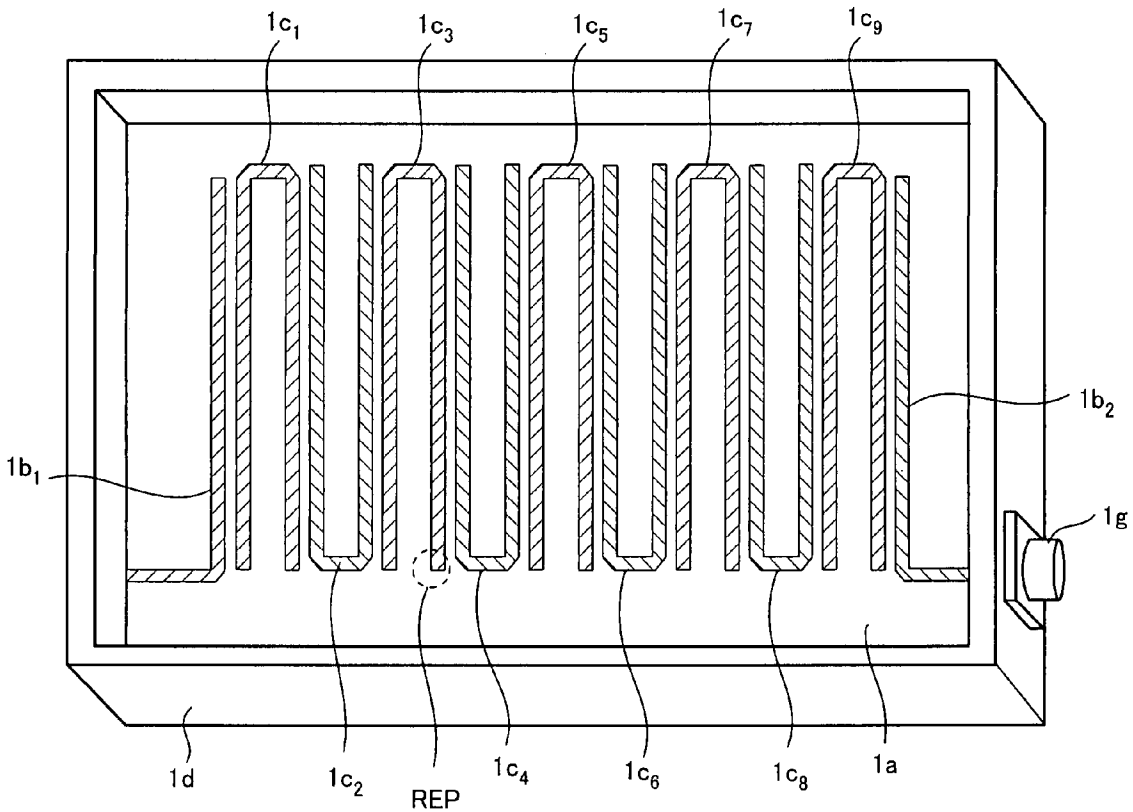
FIG. 12 PRIOR ART
FIG. 12 illustrates a hairpin filter of a nine-stage filter.

In the case of the conventional hairpin filter, each resonator is patterned to be somewhat long and the resonator end REP (see FIG. 12) is cut off to obtain the desired resonance frequency while the resonance frequency of each resonator is measured by a probe or the like. At this time the resonance frequency $f_0$ varies along the $\Delta L-f_0$ characteristic of FIG. 4. By contrast, in the case of the resonator of the present invention, each resonator is patterned to be somewhat long and L5 is cut off to obtain the desired resonance frequency while the resonance frequency of each resonator is measured by a probe or the like. At this time the resonance frequency $f_0$ varies along the $\Delta L_5-f_0$ characteristic of FIG. 4. As will be evident from the slopes of these characteristics, the amount of change in resonance frequency $f_0$ is different for an identical amount of change in length, and $f_0$ can be finely adjusted more easily with the resonator of the present invention, which has a gentle slope. That is, it can be construed that there is higher redundancy with regard to the trimming precision of the laser. Stated more simply, the center frequency can readily be adjusted to the desired value even if laser machining is somewhat coarse.

(e) Superiority of Microstrip-Line Resonator According to the Invention

The reason why the microstrip-line resonator is given the spiral shape shown in FIG. 1 is as follows: In comparison with the length of the hairpin in the conventional hairpin filter, dimensions can be diminished and the size of the overall filter reduced more with the length of the two spiral shapes arranged side by side.

Figure 5:
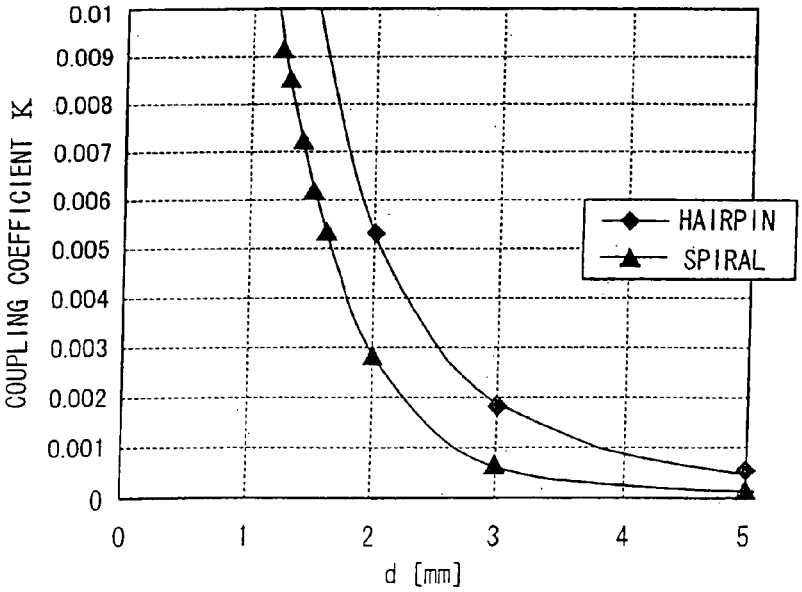
FIG. 5 shows curves illustrating the relationship of coupling coefficient k to distance d between resonators.

Further, in comparison with the conventional hairpin filter, the electromagnetic field concentrates better in the resonators with the spiral-shape filter. Consequently, jump coupling (unwanted coupling between non-adjacent resonators) within the filter is reduced. FIG. 5 represents the size of a coupling coefficient versus distance d between resonators. For the same distance d, the spiral resonator of the present invention results in a smaller coupling coefficient in comparison with the conventional hairpin resonator. As a result, unwanted jump coupling in the filter characteristic is reduced, the distance between resonators for making jump coupling less than a set value can be shortened and the transverse size of the filter can be reduced.

Further, the reason for placing the spiral shapes 12, 13 side by side is to utilize the proximity effect. That is, when the spiral shapes 12, 13 are placed close together side by side, capacitative coupling is produced between them by the proximity effect. By virtue of capacitative coupling, the length of the $\lambda/2$ wavelength can be shortened to produce the same resonance frequency, and the size of the resonator can be reduced. This fact can be proved from FIG. 4 as well. In order to produce capacitative coupling, the proximity-effect portion of the spiral resonator is made narrower or the opposing area is made larger. In other words, $\Delta$L1 is enlarged or $\Delta$L2 is enlarged. It will be understood that if this arrangement is adopted, the center frequency of the resonator declines and the rate of decrease thereof increases. On the other hand, in order to increase the resonance frequency by the amount of this decrease, it is necessary to shorten the overall length of the resonator by ΔL. However, since the amount of increase in resonance frequency with respect to ΔL is small, ΔL must be made larger than ΔL1 or ΔL2. This means that the length of the λ/2 wavelength can be reduced in order to generate the same resonance frequency.

Figure 6:
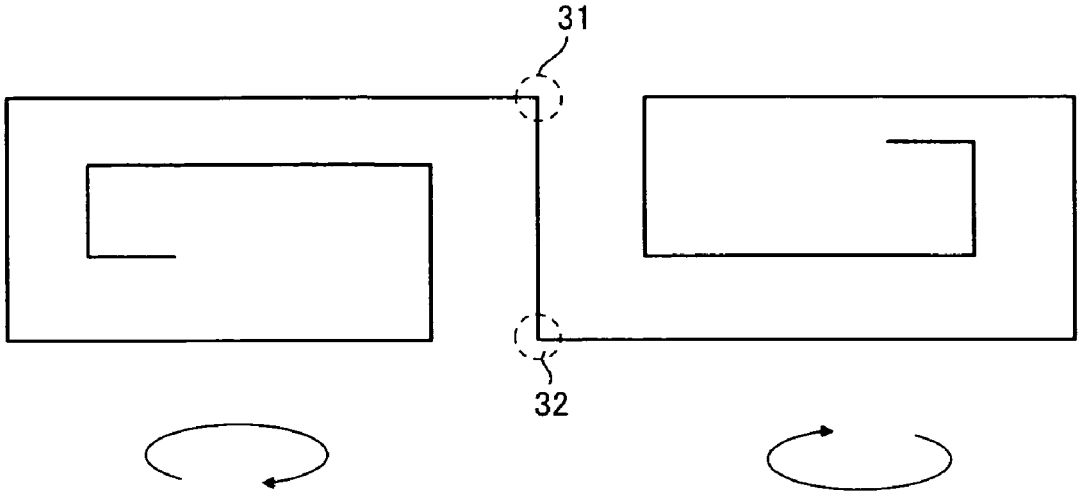
FIG. 6 is a diagram illustrating an inappropriate spiral shape as a resonator.

Further, the reason for adopting a linear shape overall for the outer-side portion 14 (see FIG. 1) of the spiral shapes on both sides inclusive of the central portion of the microstrip line is that when a curved portion is present in the considerable range that includes the central portion of the λ/2 wavelength microstrip line where current concentrates, the current density in this portion increases, the superconductivity characteristic deteriorates and distortion is produced. That is, in the case of a superconducting film, withstand power declines and distortion readily occurs. This means that it is necessary to prevent an increase in the current density. That is why the present invention makes this range linear in shape to remove curvature, thereby diminishing current density. Accordingly, it is not possible to employ a spiral resonator, as shown in FIG. 6, which has curved portions 31, 32 in the considerable range that includes the central portion of a λ/2 microstrip line where current concentrates. It should be noted that this spiral resonator is such that the orientations of the spirals are identical, unlike the spiral resonator of the present invention shown in FIG. 1.

Figure 7:
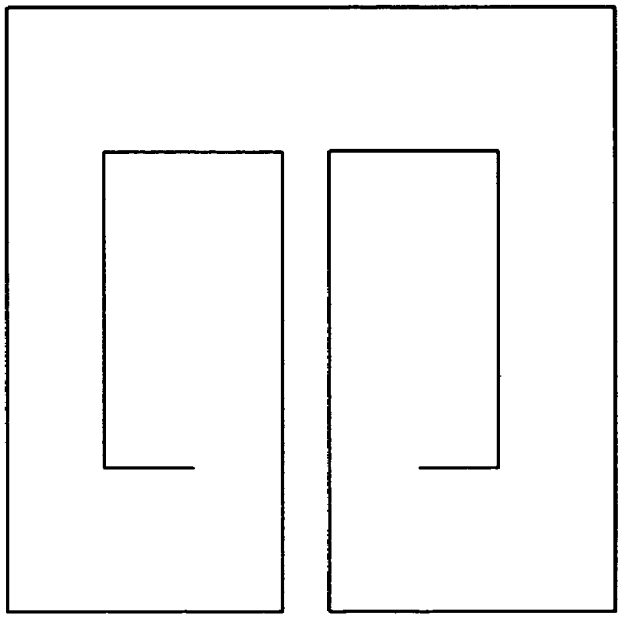
FIG. 7 is a diagram illustrating an inappropriate spiral shape as a filter.

Furthermore, in a case (FIG. 3) where a filter is constructed by arraying a number of resonators side by side in multiple stages, the transverse length of the overall filter can be reduced by disposing each individual resonator with its length along the vertical direction. In the present invention, therefore, the overall shape of each resonator is long in the vertical direction. In other words, a spiral resonator having an approximately square shape, as shown in FIG. 7, is large in size traversely and therefore cannot be employed in a filter.

(f) Spiral-Shaped Resonator and Filter Size According to the Invention

In view of the considerations above (e), the resonator shape shown in FIGS. 1 and 2 is designed to obtain a resonance frequency of 1.93 GHz and the resonator is made as compact as possible. The external dimensions of the resonator are about 10 mm×2 mm=20 $mm^2$, so that that the area ratio is about 2/3 in comparison with the hairpin filter of the prior art.

Figure 8:
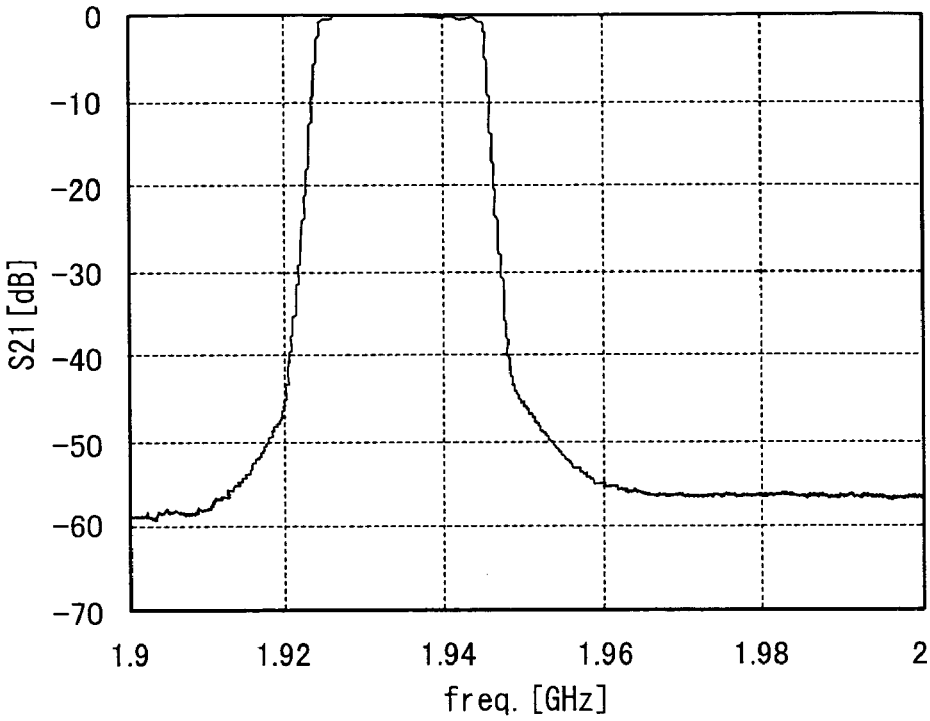
FIG. 8 shows the result of measuring a frequency characteristic of a filter according to the present invention.

Furthermore, these resonators are arrayed so as to have a suitable coupling coefficient and external Q value, and a nine-stage filter was designed as shown in FIG. 3. At this time, the layout of each of the resonators can be designed by a method similar to that of the conventional hairpin filter. That is, a correspondence between a coupling coefficient and the distance between two resonators is acquired in advance and a distance between resonators that will result in the necessary coupling coefficient is based upon the correspondence. As in the conventional hairpin filter, this method does not require special considerations in the present invention. FIG. 8 shows the result of measuring the frequency characteristic of the filter according to the present invention. The area occupied by the filter having this frequency characteristic is about 10 mm×31 mm=310 $mm^2$, which is an area ratio that is approximately 60% of the conventional hairpin filter having the same characteristic. This represents a large-scale reduction in size.

(g) Modification

First Modification

In the foregoing, ① portions on both sides from the center of the microstrip line having an electrical length corresponding to a λ/2 wavelength are each given a spiral shape and the orientations of the spirals are made opposite to each other; ② the outer-side portions of the spiral shapes on both sides inclusive of the central portion of the microstrip line are made linear in shape overall; and ③ a prescribed range from an end portion of each spiral shape is made linear in shape to form a spirally shaped resonator.

Though ③ is effective in trimming, however, this is not necessarily an arrangement required to reduce size, and a spirally shaped resonator can also be constructed according to ① and ② alone. That is, ① portions on both sides from the center of a microstrip line having an electrical length corresponding to λ/2 wavelength are made spiral in shape and the orientations of the spirals are made opposite to each other, and ② the outer-side portions of the spiral shapes on both sides inclusive of the central portion of the microstrip line are made linear in shape overall, whereby a spirally shaped resonator can be formed.

Second Modification

Figure 9:
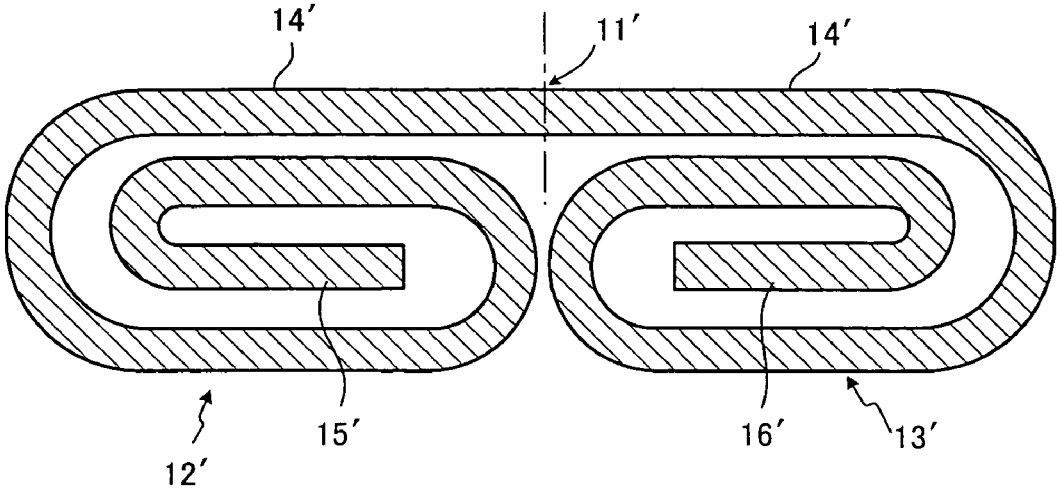
FIG. 9 is a modification of a resonator having an arcuate spiral shape.
Figure 10:
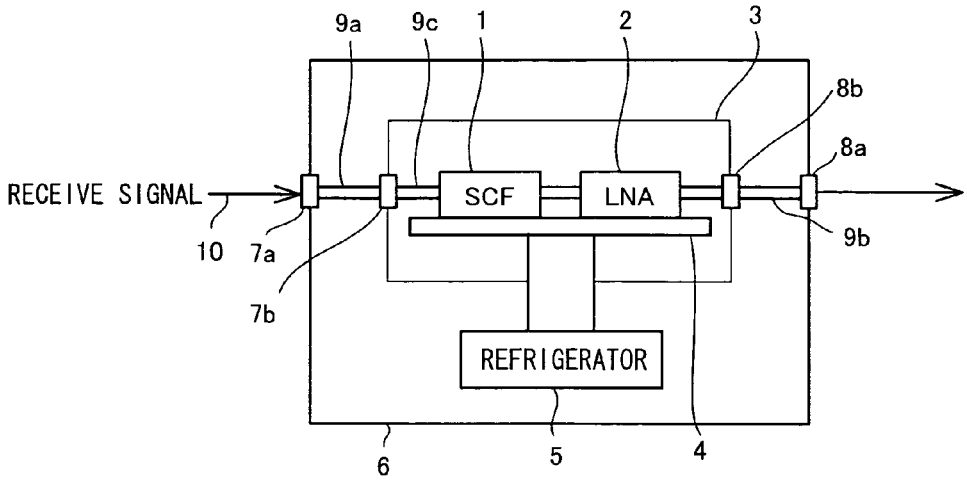
FIG. 10 PRIOR ART
FIG. 10 is a diagram showing the structure of a conventional radio reception amplifying apparatus having a superconducting filter.
Figure 11:
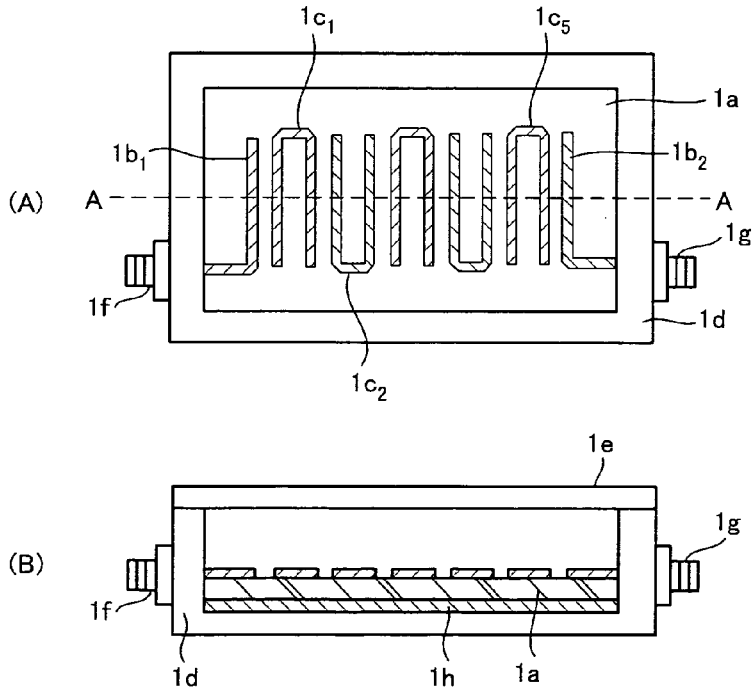
FIG. 11 PRIOR ART
FIG. 11 is a diagram for describing a superconducting filter.

In the foregoing, there has been described a spirally shaped resonator in which right-angle bent portions are provided at 12 locations and the portions between the bent portions are linearly shaped, as illustrated in FIG. 1. However, it is not necessarily required that the spiral shape be formed by right-angle bends; the bends may just as well be arcuate. FIG. 9 illustrates an example of a resonator having such an arcuate spiral shape. Here the spirals are formed with arcuate bends instead of right-angle bends. However, even in the resonator of this modification, it is required that the outer-side portions 14' of the spiral shapes on both sides inclusive of the central portion 11' of the microstrip line be made linear in shape overall, and that prescribed ranges 15', 16' from end portions of the spirally shaped portions 12', 13' be made linear in shape.

Third Modification

The foregoing is a case where the microstrip line is formed using a YBCO film, though other superconducting materials can also be used. Specifically, the microstrip line can also be formed using any of the following superconducting materials: YBCO (i.e., Y—Ba—Cu—O), RE-BCO (i.e., RE-Ba—Cu—O, where RE is any of La, Nd, Sm, Eu, Gd, Dy, Er, Tm, Yb, Lu), BSCCO (i.e., Bi—Sr—Ca—Cu—O), BPSCCO (i.e., Bi—Bp—Sr—Ca—Cu—O), HBCCO (i.e., Hg—Ba—Ca—Cu—O) and TBCCO (i.e., Tl—Ba—Ca—Cu—O).

Further, if loss is not a problem, the microstrip line need not necessarily be a superconducting material and can be formed using copper or the like.

Thus, in accordance with the present invention, size can be reduced by adopting the spiral shape. Moreover, since the spiral-shaped portions are arrayed side by side, capacitative coupling (a proximity effect) is produced between these portions and the length of λ/2 wavelength can be reduced while maintaining the same resonance frequency, thereby making it possible to reduce the size of the resonator. Further, by adopting the spiral shape, the coupling coefficient between resonators constructing a filter can be reduced, thereby enabling the spacing between them to be reduced so that the transverse size of the filter can be diminished. This makes it possible to reduce the size of the filter. As a result, in a case where a plurality of superconducting filters are cooled simultaneously, a thermally insulated vacuum vessel can be reduced in size and weight. Moreover, radiation of heat to the filter can be reduced and power consumed by the refrigerator can be suppressed.

Further, in accordance with the present invention, a considerable range that includes the central portion of the microstrip line (a portion of λ/4 wavelength from the end portion of the line) where current concentrates is made linear in shape to eliminate a curved portion, and therefore current density can be reduced in comparison with a case where a curved portion is present. As a result, withstand power can be raised and the occurrence of distortion prevented.

Further, in accordance with the present invention, even if the length of the linear portion at the end portion of the spiral shape of the resonator is changed, a change in the characteristic can be reduced in comparison with the conventional hairpin filter. As a result, adjustment of resonance frequency by trimming is easy to carry out and correction of the characteristic after filter patterning can be performed with ease.

What is claimed is:

1. A filter comprising a plurality of resonators provided side by side on a dielectric substrate, each resonator comprised of a microstrip line having an electrical length corresponding to a λ/2 wavelength, wherein each resonator includes spiral shapes, the orientations of the spirals being made opposite to each other, and a linear shape which connects the spiral shapes along an outer side portion of the spiral shapes, said linear shape inclusive of the central portion of the microstrip line; and each resonator is disposed side by side on the dielectric substrate so that the outer side portion having said linear shape of a respective resonator is placed next to a side of an adjacent resonator without the linear shape.

2. A filter according to claim 1, wherein said microstrip line is a superconducting line formed using a superconducting material which is any one of Y—Ba—Cu—O), RE-Ba—Cu—O, where RE is any of La, Nd, Sm, Eu, Gd, Dy, Er, Tm, Yb, Lu, Bi—Sr—Ca—Cu—O, Bi—Pb—Sr—Ca—Cu—O, Hg—Ba—Ca—Cu—O and Tl—Ba—Ca—Cu—O.

3. A filter according to claim 1, wherein said microstrip line is a superconducting line.

4. A filter according to claim 1, wherein said linear shape connecting linearly the end portion of each spiral shape of each resonator.

5. A filter according to claim 1, wherein the spiral shape of each resonator is long and narrow.

6. A filter according to claim 1, wherein a first linear electrode is placed in parallel with said linear shape of a resonator on an input side and an input-signal terminal of the filter and said first linear electrode are connected; and a second linear electrode is placed in parallel with said linear shape of a resonator on an output side, and a signal output terminal of the filter and said second linear electrode are connected.

* * * * *